US005380581A

United States Patent [19]

Mattesky

[11] Patent Number: 5,380,581

[45] Date of Patent: Jan. 10, 1995

[54] PATTERNED NON-WOVEN FABRICS OF IMPROVED TENSILE STRENTH

[75] Inventor: Henry Mattesky, Cedar Grove, N.J.

[73] Assignee: Herbert Glatt, Morristown, N.J.

[21] Appl. No.: 181,850

[22] Filed: Jan. 14, 1994

[51] Int. Cl.[6] ..... B32B 3/00

[52] U.S. Cl. ..... 428/195; 428/224; 428/288

[58] Field of Search ..... 428/195, 288, 224

[56] References Cited

U.S. PATENT DOCUMENTS 3,009,822 11/1961 Drelich et al. ..... 428/195

4,016,317 4/1977 Kalwaites ..... 428/88

*Primary Examiner*—James J. Bell

*Attorney, Agent, or Firm*—Omri M. Behr; Matthew J. McDonald

[57] ABSTRACT

There is disclosed an improved non-woven fabric comprising a layer of staple length fibers and a binder material diffused substantially through the fabric adhering fiber ends together to provide fabric strength. The improvement is based on the binder being arranged in a pattern in segments. These segments running substantially perpendicular to the orientation of the fibers (or the machine direction), and the pattern within these segments have a plurality of repeats within each segment and a repeat of said total segment pattern in alternate segments. The components of this pattern are mutually laterally displaced from each other in sequential segments, at least 80% of the components of said pattern being at an angle of between at least 10° to not more than 70° relative to the orientation of the majority of the fibers (or the machine direction).

24 Claims, 2 Drawing Sheets

PATTERNED NON-WOVEN FABRICS OF IMPROVED TENSILE STRENTH

FIELD OF THE INVENTION

Patterned non woven fabrics of improved tensile strength.

DESCRIPTION OF THE PRIOR ART

The general methodology of forming non woven fabrics and providing patterned binders thereto is well known in the art. These methods are disclosed in Kalwaites, U.S. Pat. No. 4,016,317 and Dreilich, et. al., U.S. Pat. No. 3,009,822. The fabrics may also be produced on apertured web equipment sold by Honeycomb Systems Inc., PO Box 502, Biddeford, Me. and by Perforjet of Grenoble, France.

SUMMARY OF THE INVENTION

The basic fabrics utilized in this invention may be those having substantially oriented fibers and those having randomly carded fibers. The methods of making such fabrics are disclosed in Kalwaites, U.S. Pat. No. 4,016,317 and Dreilich, et. al., U.S. Pat. No. 3,009,822. The disclosures of these patents are incorporated herein by reference. The purpose of the present invention is to improve the physical properties of such fabrics, particularly their tensile strength and toughness defined as the ability of the web to elongate but not tear. It is the surprising finding of the present invention that this end may be readily achieved by patterning the binder in the fabric in a predetermined manner.

The non-woven fabrics utilized as substrates in the present invention are of two types, the first, wherein most of the fibers are randomly distributed in distinct, fine, bundles, forming areas of high and low density throughout the web. and the second where the fibers are distributed evenly throughout the web. The improvements of the present invention are substantially equally applicable to both modes.

In the first mode, the fabric comprises a layer of staple length fibers arranged in a predetermined pattern of yarn-like fiber bundles, these bundles comprise a plurality of fiber segments with the segments being consolidated and substantial parallelism within each bundle, the bundles being located between spaced generally parallel planes generally defining the opposed surfaces of the fabric, and have a binder material diffused substantially through the fabric adhering fibers together, at random areas throughout the fiber length to provide fabric strength.

In the second mode, a fibrous non-woven fabric comprises a web of overlapping intersecting fibers, the majority of said fibers being oriented essentially in one direction and a binder material diffused substantially through the fabric adhering fibers, together at random areas throughout the fiber length to provide fabric strength.

The improvement in the present invention lies in the binder being arranged in a pattern in segments. In the first mode, the segments run substantially perpendicular to the orientation of the fibers, in the second perpendicular to the machine direction, which is the same thing to all intents and purposes. The pattern within the segments has a plurality of repeats within each segment and a repeat of the total segment pattern in alternate segments. Furthermore, the components of the pattern are mutually laterally displaced from each other in sequential segments, with at least 80% of the components of said pattern being at an angle of between at least 10° to not more than 70° relative to the orientation of the majority of the fibers.

In the first mode the fiber bundles define a predetermined pattern of areas of low fiber density throughout the fabric, if desired the areas of low fiber density are openings.

In both modes the pattern in each segment may be continuous or discontinuous. The pattern in each segment may comprise sectors which are substantially linear and have a predetermined width. If desired, the height of each segment is at least twice the width of the said linear sector and/or the distance between said substantially linear sectors is at least 50% of the width of said linear sectors. In the preferred embodiment, the pattern is substantially as shown in FIG. 1.

In both modes the binder forming the pattern is suitably an acrylic/eva binder and the dry weight of the binder forming the pattern comprises from about 10 to about 50% suitably 25–40% by weight of the fibers utilized in the fabric.

DETAILED DESCRIPTION OF THE DRAWINGS

Figure 1:
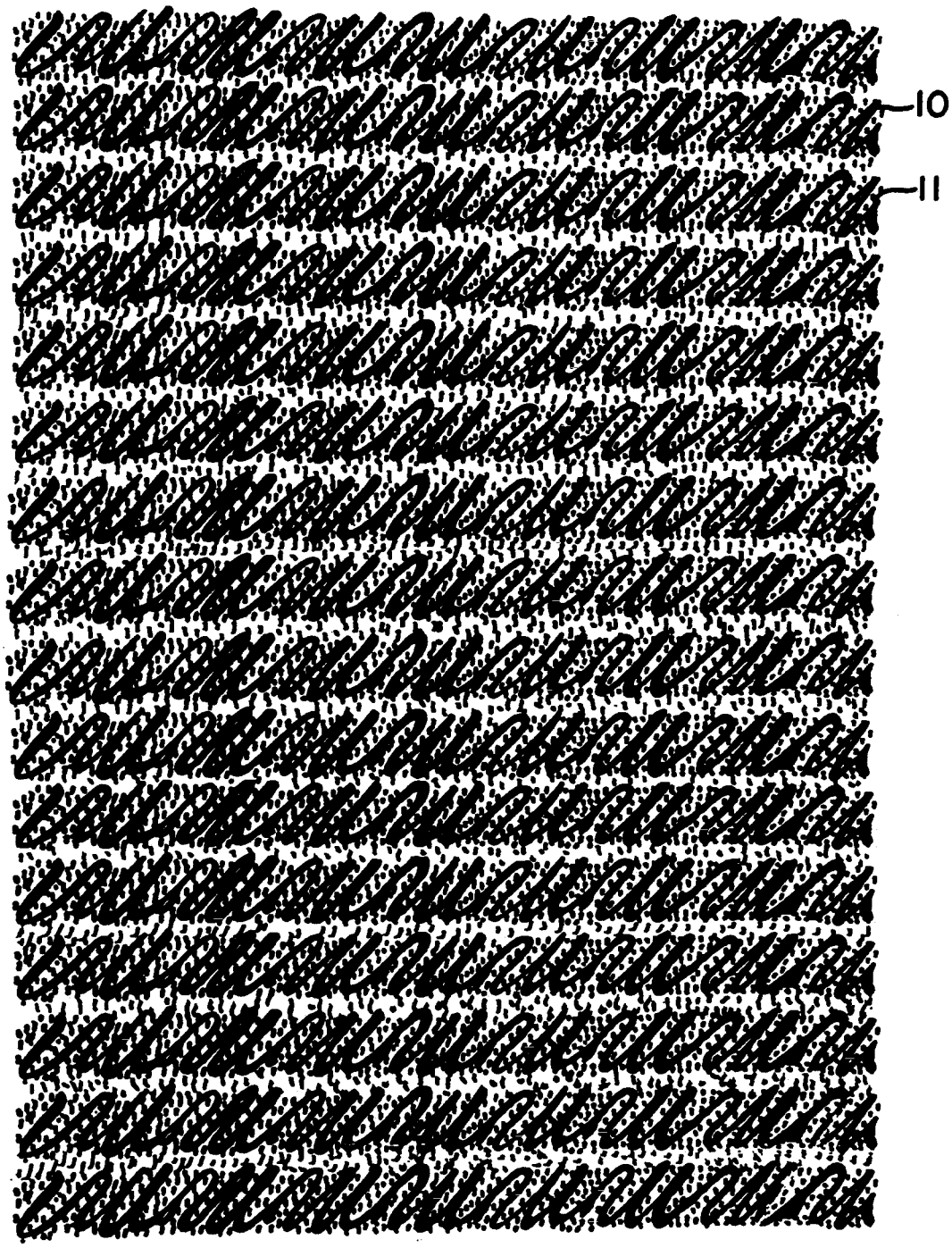
FIG. 1 is a plan view of a preferred pattern of binder.

In FIG. 1, there is shown a sheet of fabric having two mutually displaced binder patterns 10 and 11 repeatedly placed thereon.

Figure 2:
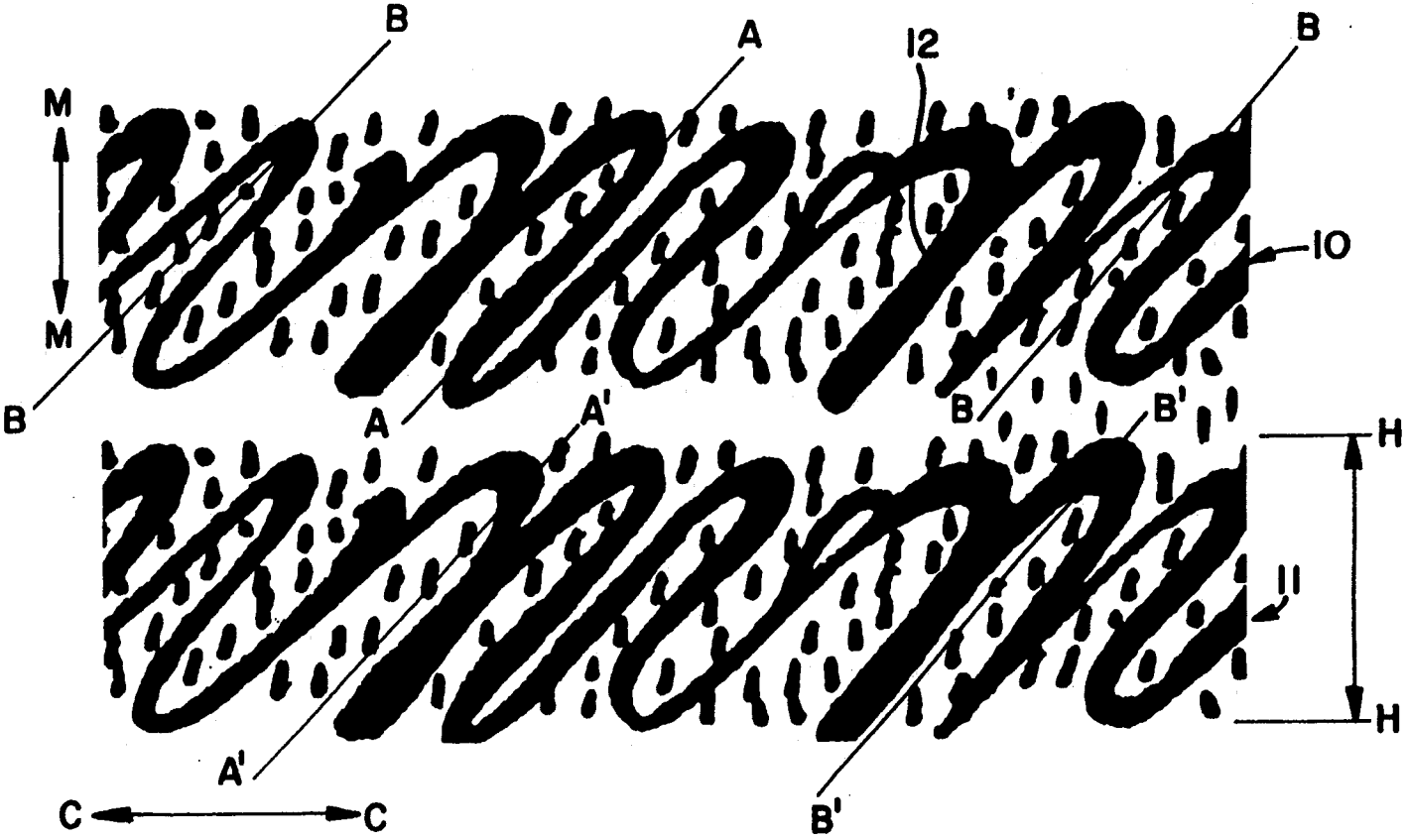
FIG. 2 is an enlarged segment of FIG. 1.

FIG. 2 shows such patterning in greater detail. Arrows MM indicate the machine direction, CC the cross direction and HH the height of pattern. A typical sector line is designated 12. The portion AA to BB is the repeat pattern in a segment. A'A' to B'B' is the same portion as AA to BB, but laterally displaced. This lateral displacement avoids the occurrence of lines of binder weakness.

The process of preparing and printing the fabric are substantially the same as those disclosed in U.S. Pat. Nos. 3,009,822 and 4,016,317 as well as any substantial equivalent thereof known to the art or apparent to one skilled in the art. All of such variations are considered within the scope of the present invention.

EXAMPLE

A card web comprising 0.25 tex, 1 9/16" staple rayon/acrylic weighing about 1.62 oz/square yard and 1 ply thickness of 13.5 mils, is printed on a rotogravure print unit carrying the pattern shown in FIG. 1 as segments 10 and 11 in several repeats. The binder used is acrylic/EVA (acrylic/ethyl vinyl acetate) applied at an ultimate dry weight ratio of 35% w/w of fiber weight.

PHYSICAL PROPERTIES OF WIPES

| Physical Properties | | Handi-Wipes | New Magla "M" Wipes |
|---|---|---|---|
| Basis Weight oz/yd 2 | | 1.62 | 1.36 |
| Fiber Blend Rayon/Acrylic | | 75/25 | 85/15 |
| 1 Ply Thickness (Mils) | | 13 | 13.5 |
| Tensiles Dry MD | | 6250 | 7285 |
| (g/in) | Dry CD | 1182 | 1137 |
| | Wet MD | 3049 | 3835 |
| | Wet CD | 578 | 595 |
| Elongation Dry MD | | 10.2 | 9.8 |

-continued

| PHYSICAL PROPERTIES OF WIPES | | |
|---|---|---|
| Physical Properties | Handi-Wipes | New Magla "M" Wipes |
| Dry CD | 32.2 | 50 |
| Wet MD | 17.2 | 18 |
| Wet CD | 40 | 66.5 |
| Absorbency (seconds) | 1.8 | 1.8 |
| Absorbency Capacity | 9.33 | 6 |

I claim:

1. In a non-woven fabric comprising a layer of staple length fibers arranged in a predetermined pattern of yarn-like fiber bundles, said bundles comprising a plurality of fiber segments with the segments being consolidated and in a substantial parallelism within each bundle, said bundles being located between spaced generally parallel planes generally defining the opposed surfaces of the fabric, and a binder material diffused substantially through the fabric adhering fibers together to provide fabric strength, the improvement wherein the binder is arranged in a pattern in segments, said segments running substantially perpendicular to the orientation of the fibers, the pattern within said segments having a plurality of repeats within each segment and a repeat of said total segment pattern in alternate segments, said the components of said pattern being mutually laterally displaced from each other in sequential segments, at least 80% of the components of said pattern being at an angle of between at least 10° to not more than 70° relative to the orientation of the majority of the fibers.

2. In the fabric of claim 1 the improvement wherein said fiber bundles define a predetermined pattern of areas of low fiber density throughout the fabric.

3. In the fabric of claim 1 the improvement wherein said areas of low fiber density are openings.

4. In the fabric of claim 1 the improvement wherein the pattern in each segment is continuous.

5. In the fabric of claim 1 the improvement wherein the pattern in each segment is discontinuous.

6. In the fabric of claim 1 the improvement wherein the pattern in each segment comprises sectors which are substantially linear and have a predetermined width.

7. In the fabric of claim 1 the improvement wherein the height of each segment is at least twice the width of the said linear sector.

8. In the fabric of claim 1 the improvement wherein the distance between said substantially linear sectors is at least 50% of the width of said linear sectors.

9. In the fabric of claim 1 the improvement wherein the pattern is substantially as shown in FIG. 1.

10. In the fabric of claim 1 the improvement wherein the binder forming the pattern is an acrylic/eva binder.

11. In the fabric of claim 1 the improvement wherein dry weight of the binder forming the pattern comprises from about 10 to about 50% by weight of the fibers utilized in the fabric.

12. In the fabric of claim 1 the improvement wherein dry weight of the binder forming the pattern comprises from about 25 to about 40% by weight of the fibers utilized in the fabric.

13. In a fibrous non-woven fabric comprising a web of overlapping intersecting fibers, the majority of said fibers being oriented essentially in one direction and a binder material diffused substantially through the fabric adhering fibers together to provide fabric strength, the improvement wherein the binder is arranged in a pattern in segments, said segments running substantially perpendicular to the orientation of the fibers, the pattern within said segments having a plurality of repeats within each segment and a repeat of said total segment pattern in alternate segments, said the components of said pattern being mutually laterally displaced from each other in sequential segments, at least 80% of the components of said pattern being at an angle of between at least 10° to not more than 70° relative to the orientation of the majority of the fibers.

14. In the fabric of claim 11 the improvement wherein there are areas of low fiber density throughout the fabric.

15. In the fabric of claim 11 the improvement wherein said areas of low fiber density are openings.

16. In the fabric of claim 11 the improvement wherein the pattern in each segment is continuous.

17. In the fabric of claim 11 the improvement wherein the pattern in each segment is discontinuous.

18. In the fabric of claim 11 the improvement wherein the pattern in each segment comprises sectors which are substantially linear and have a predetermined width.

19. In the fabric of claim 11 the improvement wherein the height of each segment is at least twice the width of the said linear sector.

20. In the fabric of claim 11 the improvement wherein the distance between said substantially linear sectors is at least 50% of the width of said linear sectors.

21. In the fabric of claim 11 the improvement wherein the pattern is substantially as shown in FIG. 11.

22. In the fabric of claim 11 the improvement wherein the binder forming the pattern is an acrylic/eva binder.

23. In the fabric of claim 11 the improvement wherein dry weight of the binder forming the pattern comprises from about 10 to about 50% by weight of the fibers utilized in the fabric.

24. In the fabric of claim 11 the improvement wherein dry weight of the binder forming the pattern comprises from about 25 to about 40% by weight of the fibers utilized in the fabric.

* * * * *